US005107931A

United States Patent [19]

Valka et al.

[11] Patent Number: 5,107,931

[45] Date of Patent: Apr. 28, 1992

[54] TEMPORARY ABANDONMENT CAP AND TOOL

[76] Inventors: William A. Valka, 22802 Canyon Lake, Spring, Tex. 77373; Randy J. Wester, Av. Sernambetiba No. 3600, Bloco 3, Apto. 2002, Bara da Tijuca, Rio de Janeiro - RJ, Brazil

[21] Appl. No.: 613,432

[22] Filed: Nov. 14, 1990

[51] Int. Cl.[5] ..... E21B 33/043

[52] U.S. Cl. ..... 166/342; 166/351; 405/195.1

[58] Field of Search ..... 166/338-342, 166/349, 351, 363-365, 368, 85, 97; 405/195, 211, 224

[56] References Cited

U.S. PATENT DOCUMENTS

| | | | |
|---|---|---|---|
| 3,601,188 | 8/1971 | McGlamery | 166/351 |
| 3,945,213 | 3/1976 | Forbes et al. | 166/351 |
| 4,323,118 | 4/1982 | Bergmann | 166/364 |
| 4,387,771 | 6/1983 | Jones | 166/349 |
| 4,434,853 | 3/1984 | Bourgeois | 166/85 |
| 4,600,339 | 7/1986 | Castel | 405/211 |
| 4,960,174 | 10/1990 | Rodrigues et al. | 166/342 |
| 5,005,650 | 4/1991 | Hopper | 405/195 |

*Primary Examiner*—William P. Neuder

*Attorney, Agent, or Firm*—W. William Ritt, Jr.; Richard B. Megley

[57] ABSTRACT

A protective cap (12) can be run onto and retrieved from a subsea wellhead (10) from a floating service vessel. Slidably mounted shear pins (32) in the cylindrical wall (14) of the protective cap (12) allow the cap to be attached by a downward push. Retrieval of the protective cap (12) involves an overpull on the drill string that is sufficient to shear the pins (32) in the cylindrical wall (14).

25 Claims, 8 Drawing Sheets

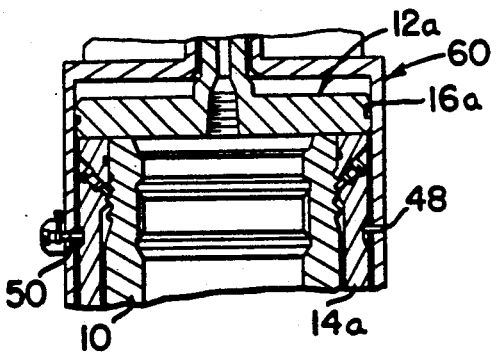
FIG_12
FIG_11
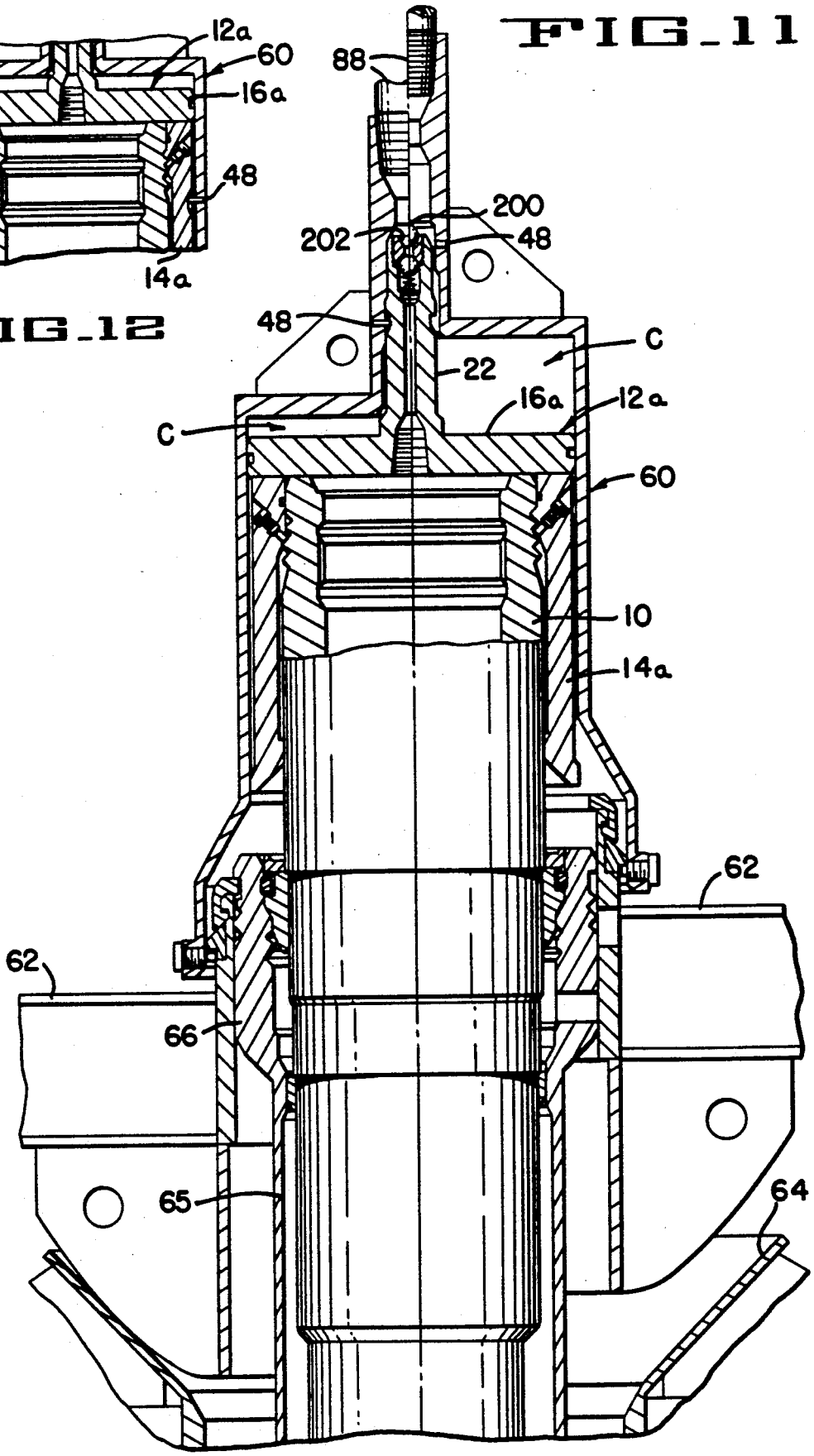

TEMPORARY ABANDONMENT CAP AND TOOL

This invention relates to off-shore well drilling, and more particularly to a reusable protective temporary abandonment cap that can be placed on and retrieved from an open pipe or wellhead of a subsea well.

BACKGROUND

When drilling offshore wells for oil and gas from a rig on a floating vessel, a guide structure is attached to a wellhead housing which is mounted on a conductor pipe usually having a nominal 30 inch diameter. The guide structure usually has four upstanding posts on a six foot radius at the ends of generally horizontal arms. The wellhead housing is landed in and attached to the guide structure and thereafter run to the ocean floor. Removal and replacement of the guide structure is frequently desired.

Operation at a drilling site is interrupted for variable periods of time. When work is temporarily suspended or abandoned for an indeterminate period of time, it is desirable to protect the wellhead.

SUMMARY OF THE INVENTION

According to the invention, a novel protective temporary abandonment cap is provided for covering the underwater wellhead. The protective cap is shaped and structured to enable running it onto the wellhead and retrieving it for reuse at a later time on the same or different wellhead.

The protective cap is in the form of an inverted cup which has shear pins that are mounted in the cylindrical wall of the cup for sliding movement in a direction that allows installation on the upper end of the wellhead by a downwardly directed force and removal by an upwardly directed pull on the pipe string that is employed to run and retrieve the cap. The upper end wall of the cap may be provided with a check valve that allows pressure buildup below the cap to be relieved.

The cap is characterized by having a quick connect and disconnect structure that can be actuated from the surface vessel. When the cap is lowered onto the wellhead, a tool is used for engaging a stem on the cap's upper end. The tool structure is shaped to allow removal by either an overpull or a rotation and then a regular pull. The same tool structure can be used for retrieval of the cap by grasping the cap stem and applying an overpull force on the running string that is sufficient to shear or otherwise render ineffective the shear pins in the cup's cylindrical wall.

These and other objects and advantages of the invention will become more fully apparent from the claims and from the description as it proceeds in conjunction with the appended drawings.

BRIEF DESCRIPTION OF DRAWINGS

FIG. 11 is an elevation in central section of the retrieved tool of FIG. 5 and the protective cap of FIG. 6, illustrating retrieval of the guide base after installing the cap; and FIG. 12 is a fragmentary view of the tool and cap of FIG. 11, showing an alternate location for the tool-to-cap retrieval pins and shear pins.

DETAILED DESCRIPTION OF PREFERRED EMBODIMENTS

Figure 1:
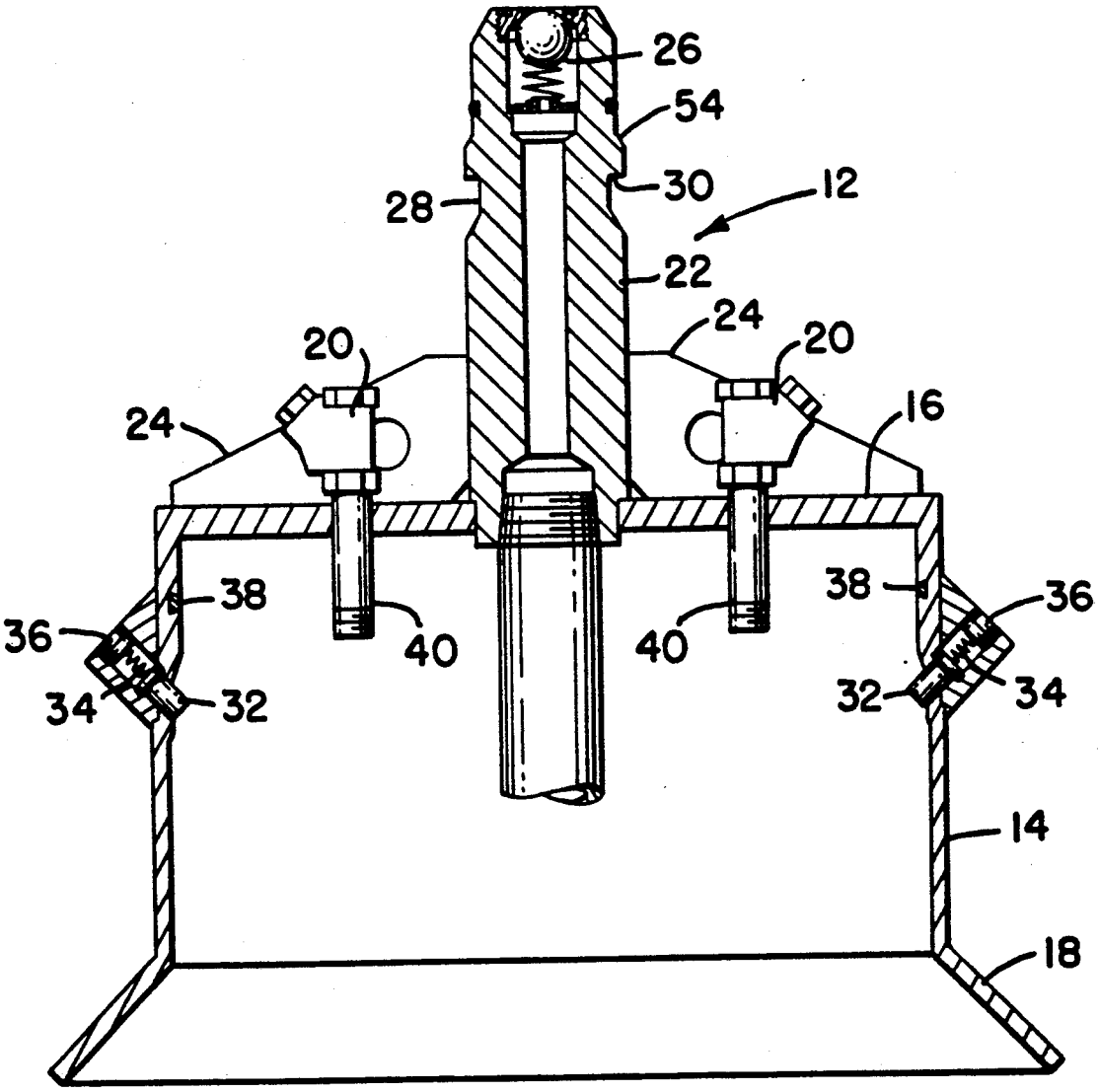
FIG. 1 is an elevation in central section of a protective cap embodying the present invention.
Figure 4:
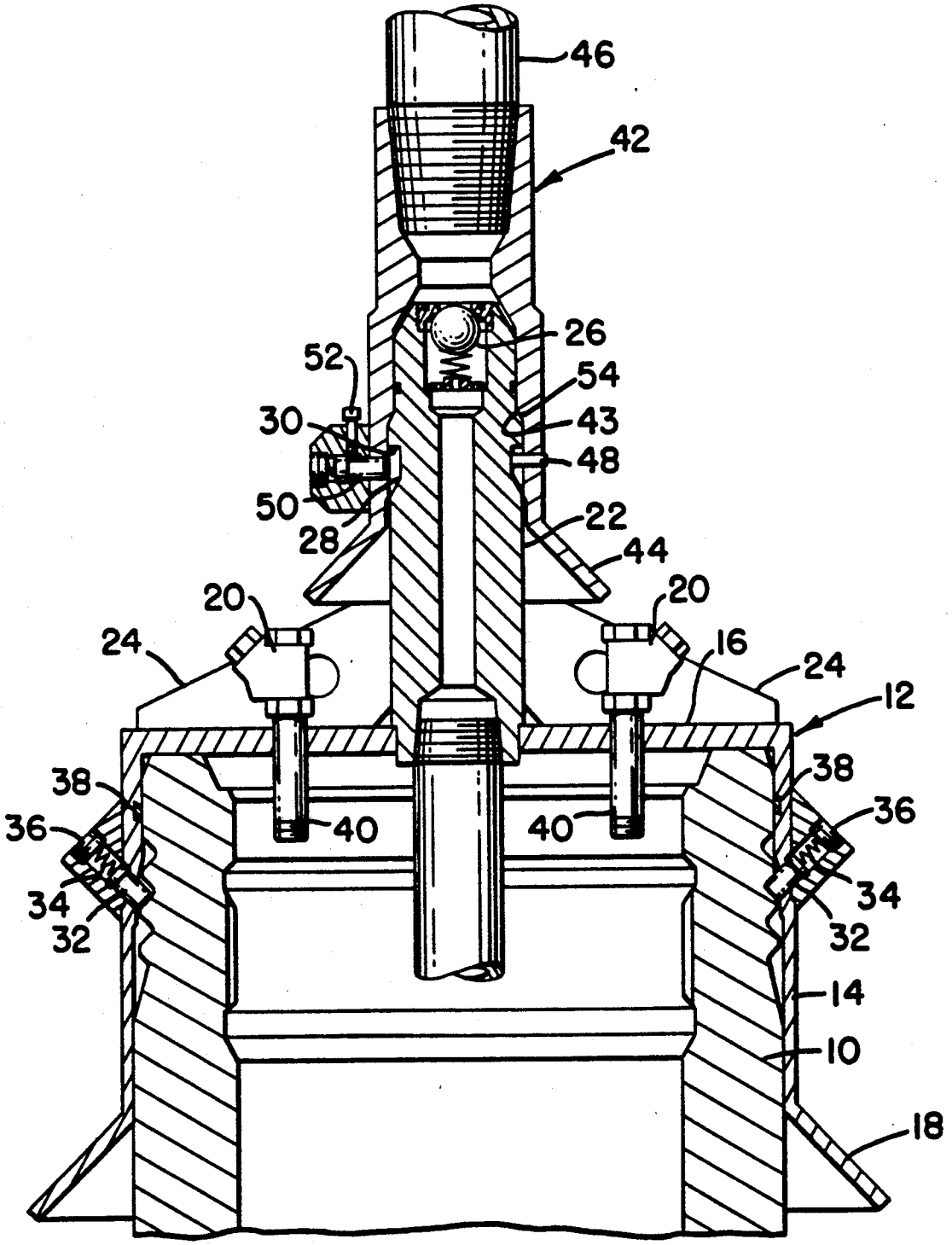
FIG. 4 is an elevation in central section of the tool and protective cap of FIG. 1 in position on a wellhead.

A temporary abandonment protective cap 12 embodying the present invention for a subsea wellhead is illustrated in FIG. 1. Such a cap is used to protect the wellhead when the drilling or completion program is temporarily suspended. In FIG. 4 the wellhead 10 is shown extending upwardly with an open end that is covered by the protective cap 12 of FIG. 1.

The protective cap 12 of FIG. 1 comprises an inverted cup having a generally cylindrical wall 14 which is open at its lower end and closed by an upper end wall 16. The lower end is surrounded by a conically shaped wall forming a funnel 18 to assist with alignment of the cap 12 on the wellhead 10. The upper wall 16 is provided with one or more one-way fluid flow valves 20 which allow any pressure buildup below the cap 12 to be relieved. The purpose of the cap 12 is to protect the wellhead or well pipe over which the cap is fitted, and is not designed to contain pressure.

A stem 22 extends upwardly from the upper wall 16 and is welded or otherwise rigidly secured thereto. Strengthening ribs 24 are attached as by welding to both the stem 22 and the upper wall 16. The stem may advantageously have a check valve 26 which may be used to allow fluid injection with the exit check valves 20 provided for displacing water.

The stem 22 has an external profile that is used when running the protective cap 12 for attachment to the wellhead 10, and for retrieving the cap when the drilling or completion program is to be resumed. This profile includes a groove 28 having an annular radial shoulder 30 for use as part of the connection to a running and retrieving tool 42 that is illustrated in FIGS. 2 and 3.

With continued reference to FIG. 1, the cylindrical side wall 14 of the protective cap 12 is provided with a plurality of retractable pins 32 mounted for slidable movement along an axis that is inclined at an angle of about 45° relative to the central axis of the cylindrical wall 14. Pins 32 are biased to their illustrated position as by springs 34 that are compressed by set screws 36. Above the pins 32 is a groove for an O-ring 38 to seal the cap to the wellhead 10. Inlet pipes 40 for the valves 20 extend downwardly below the O-ring 38.

Figure 2:
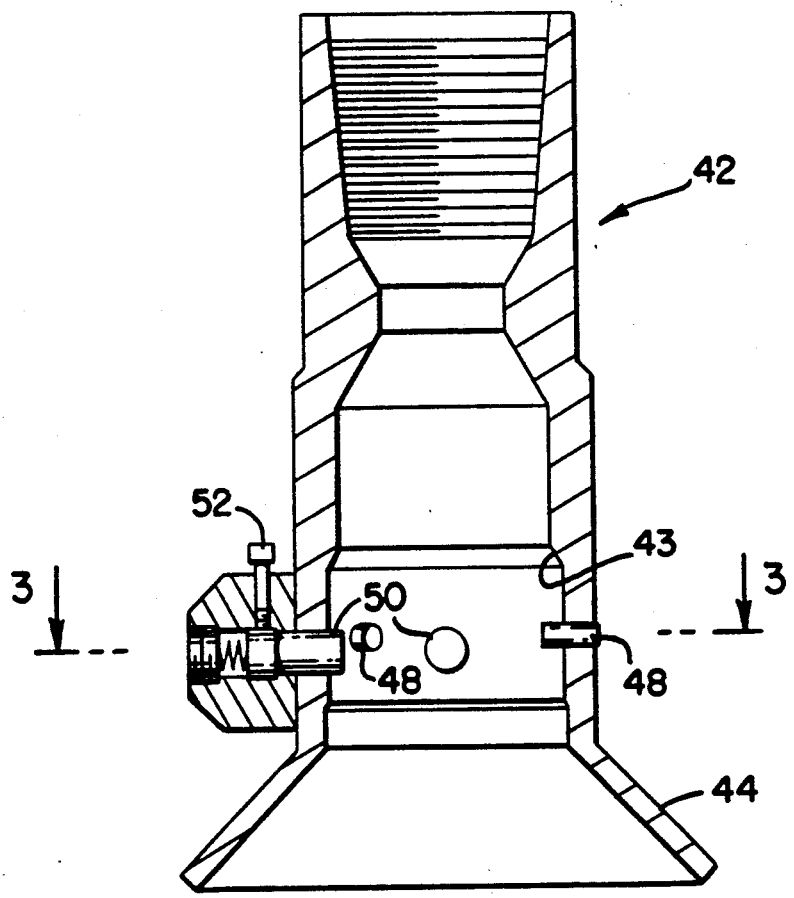
FIG. 2 is an elevation in central section of a tool for attachment to the protective cap of FIG. 1.
Figure 3:
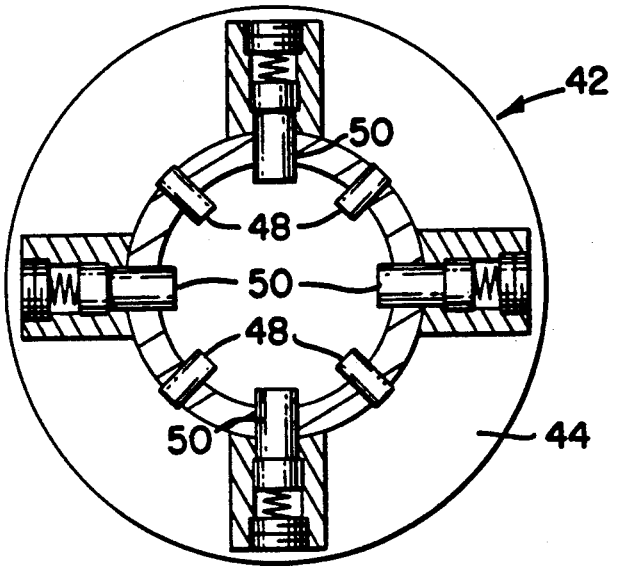
FIG. 3 is a plan view in section taken along lines 3—3 of FIG. 2.

Turning now to FIGS. 2 and 3, the running and retrieving tool 42 is provided with a funnel-shaped lower end 44 and an interiorly threaded upper end for connection to a drill string or other running string 46 (FIG. 4) that can impart both axial and rotary motion to the tool 42. The tool 42 is provided with eight radial holes through which extend two groups of four pins 48, 50. Pins 48 are adapted for fracturing or shearing at a relatively low pulling force exerted through the running string 46 to disengage the tool 42 from the protective cap 12 after the cap has been attached to the wellhead 10 (FIG. 4).

Retractable pins 50 are spring biased to the position illustrated in FIGS. 2 and 3 by springs and set screws in a manner similar to that shown in connection with pins 32 in the cylindrical wall of the protective cap 12 (FIG. 1). In addition, a lock screw 52 (FIGS. 2 and 4) is provided for each of the pins 50 so that during running of the cap 12 the pins 50 can be held in their retracted position (FIG. 4). However, prepatory to retrieval of the cap 12 the lock screws 52 are backed out to allow pins 50 to assume their inwardly-biased functional position shown in FIGS. 2 and 3.

The upper end of wellhead 10 (FIG. 4) has an external profile with annular grooves into which extend the retractable pins 32 of the protective cap 12. When the cap 12 moves downwardly during its installation on the upper end of wellhead 10 the pins 32, by reason of their angled orientation, follow the profile until the cap comes to rest on the wellhead (FIG. 4), at which time the pins extend into the adjacent wellhead groove to lock the cap to the wellhead in the illustrated position.

The cap stem 22 fits into the lower end of tool 42 where cap shoulder 54 and tool shoulder 43 engage. This provides an alignment of the groove 28 in cap stem 22 with the pins 48 and 50 of tool 42. When the protective cap 12 is on-board the surface vessel, stem 22 is inserted into tool 42 with pins 48 and 50 retracted. After insertion, pins 48 are driven into the position illustrated in FIG. 4 while pins 50 are held in their retracted position by lock screws 52. Thereafter, the protective cap 12 is lowered into functional position on wellhead 10.

To retrieve the tool 42 while leaving the cap 12 in place on the wellhead 10 an overpull lifting force, such as in excess of 10,000 pounds but not greater than about 30,000 pounds, is exerted on the drill string 46, whereby pins 48 shear and the tool 42 separates from the cap 12 which remains on the wellhead 10. The tool 42 is then retrieved on-board the surface vessel for repeated use.

When the tool 42 is to be used to remove and retrieve the cap 12 from the wellhead 10, the lock screws 52 are backed out or removed to release the pins 50 and allow them to move radially inwardly while the tool 42 is aboard the surface vessel. As the tool 42 is subsequently lowered onto stem 22 of the protective cap 12, pins 50 follow the stem profile and then move into groove 28, thereby establishing a connection between the drill string 46 and cap 12. When the drill string 46 is then lifted the pins 32 in the cylindrical body of the cap shear, releasing the cap from the wellhead 10. The pins 32 preferably are designed to shear at an overpull of about 80,000 pounds, whereas pins 50 are of much stronger design and, in some embodiments, preferably withstand an overpull up to about 180,000 pounds.

Figure 5:
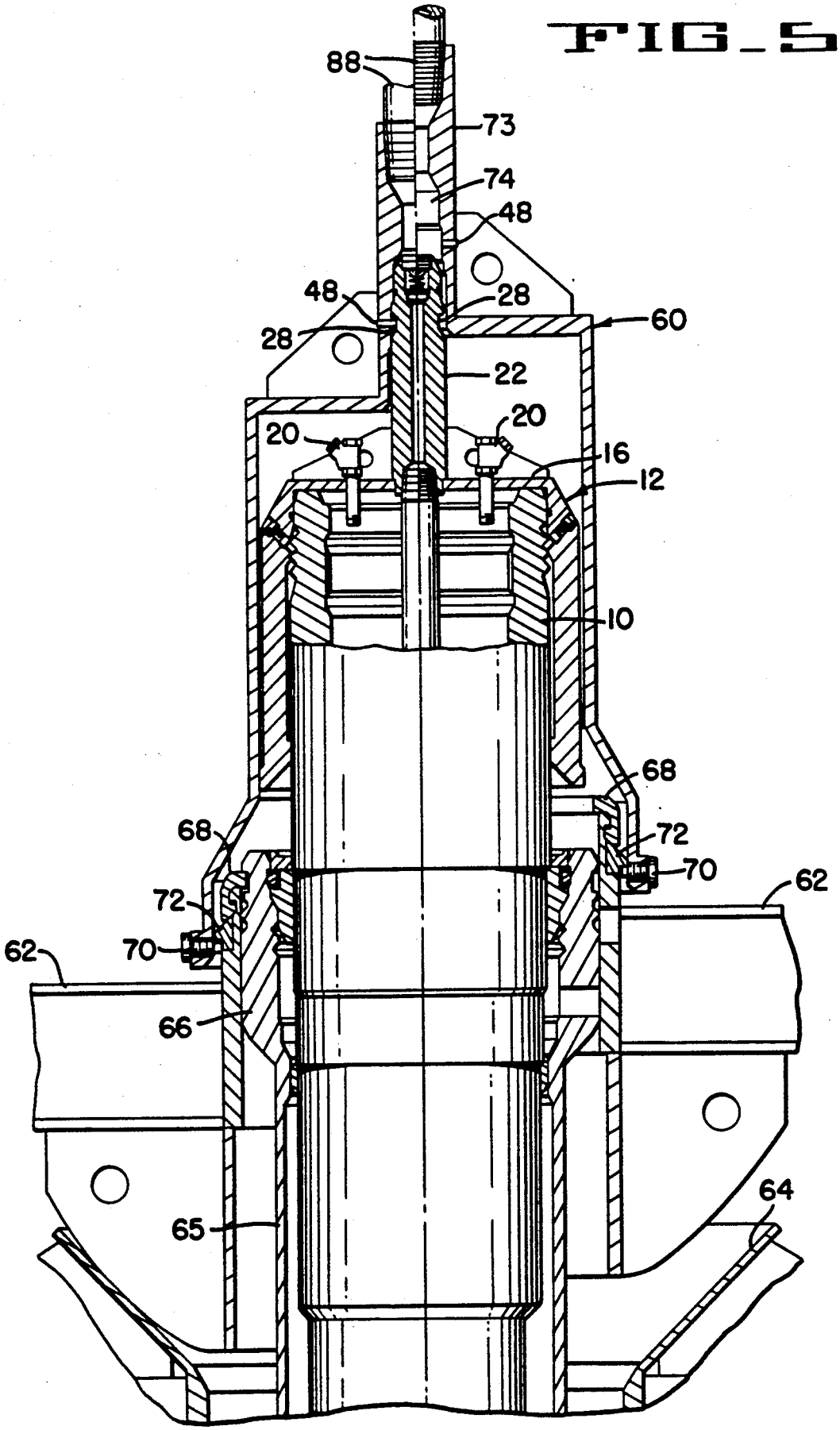
FIG. 5 is an elevation in central section of a retrieval tool for removing the well guide base from the seafloor after installing the protective cap of FIG. 1 on the wellhead.

FIG. 5 illustrates another apparatus adapted to lower and install the protective cap 12 on the upper end of the wellhead 10 as described in connection with FIG. 4. This apparatus includes a modified guide base retrieval tool 60 of a known type for retrieving a guide base 62 which is used to guide the lowering of a string of conductor pipe 65 and its housing 66 onto a previously installed guide base funnel 64 on the seafloor. The guide base 62 and the conductor pipe housing 66 are releasably connected together by a split locking ring 68. When it is desired to retrieve the guide base 62, retrieval tool 60 is lowered on a running string 88 to the position shown in the left side of FIG. 5 so that spring-biased retractable pins 70 are beneath a ring 72 that is axially slidable upwardly to spread the split ring 68 by an amount sufficient to unlock the guide base 62 from the conductor pipe housing 66. When the running string 88 is lifted the guide base 62, the split ring 68 and the ring 72 all move upwardly with the tool 60 for retrieval at the surface vessel.

The upper end of retrieval tool 60 is formed to function as the tool 42 of FIGS. 2 and 3. An upper central connector portion 73 has a central bore 74, the surrounding wall of which contains apertures through which the shear pins 48 extend. The bore 74 fits over the profiled stem 22 of the protective cap which is shown with groove 28. Since this operation involves running the protective cap 12, shear pins 48 are used to secure the protective cap 12 to the retrieval tool 60. As explained above, the pins 48 shear as the lifting movement starts and thus the tool 60 may be lifted for retrieval of the guide base 62, as illustrated on the right side of FIG. 5, without removing the protective cap 12. It should also be understood that the tool 60 can be used to run and install the protective cap 12 and during the same traverse to the seafloor, retrieve the guide base 62 that had been installed previously.

Figure 6:
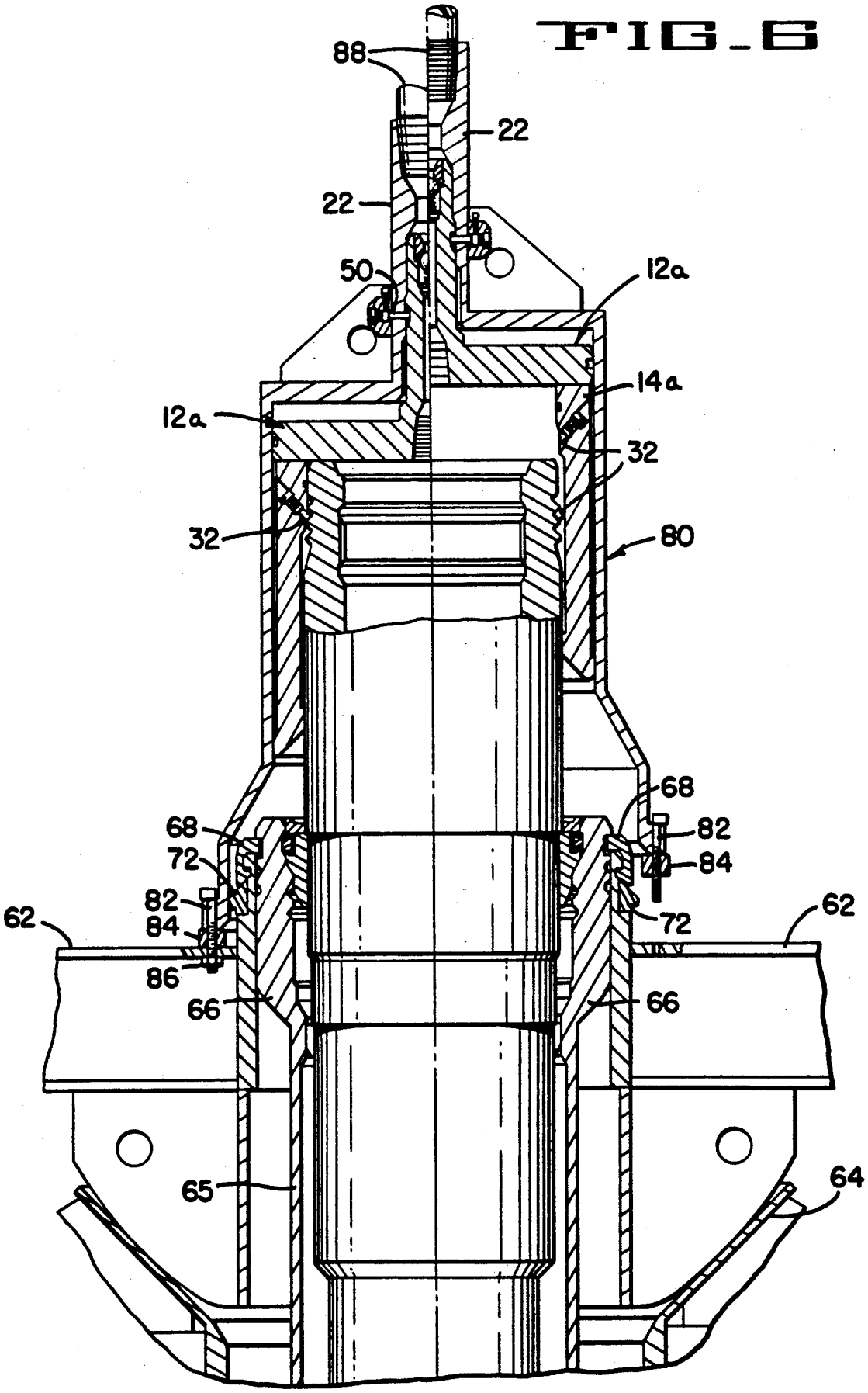
FIG. 6 is an elevation in central section of a running tool for installing a subsea well guide base on a subsea wellhead and retrieving a second embodiment of protective cap that has been previously installed on the wellhead.

FIG. 6 illustrates a running tool 80 of a known type, but which has been modified for running the same guide base 62 as discussed in conjunction with the apparatus shown in FIG. 5. Tool 80 has a plurality of circumferentially spaced axial apertures or bores at its lower end for receiving bolts 82 that cooperate with nuts 86 (only one shown) to provide a means of attaching the tool to the guide base 62. Depending upon the dimensioning and desired position, a plurality of spacers 84 of appropriate length can be employed with the bolts 82 to assure proper spacing. The nuts 86 are designed to strip off the threaded portions of bolts 82 upon exertion of a predetermined vertical force on the upper end of the tool 80, such as by lifting the running string 88, whereby the tool 80 separates from the guide base 62 as illustrated in the right hand side of FIG. 6.

The upper end of tool 80 may have the same configuration as the upper end of the tool 60 described in connection with FIG. 5. The tool 80, however, has retractable pins 50 that function in the same manner as their counterparts in the tool of FIGS. 2–4. Thus the pins 80 slide downwardly along the outer surface of stem 22 of the protective cap **12*a* prepositioned on the upper end of the wellhead 10, and engage the groove 28 of that stem to connect the tool 80 to the cap 12*a***.

Pins 50 are stronger than pins 32 in the cylindrical wall **14*a* of the protective cap 12*a*. Therefore, when an overpull force of about 80,000 pounds is reached, the pins 32 shear off or otherwise become ineffective, and the protective cap 12*a* rises off the top of the wellhead 10 as indicated in the right half of FIG. 6**.

When drilling or completion procedures are to be resumed at a well containing a protective cap **12*a*, it is frequently desired to run the guide base 62 and remove the cap 12***a*. With the apparatus of FIG. 6 the guide base 62 can be run by the tool 80 and connected to the conductor pipe housing 66, and the cap 12*a* then removed and retrieved to the surface vessel in one round trip.

Figure 7:
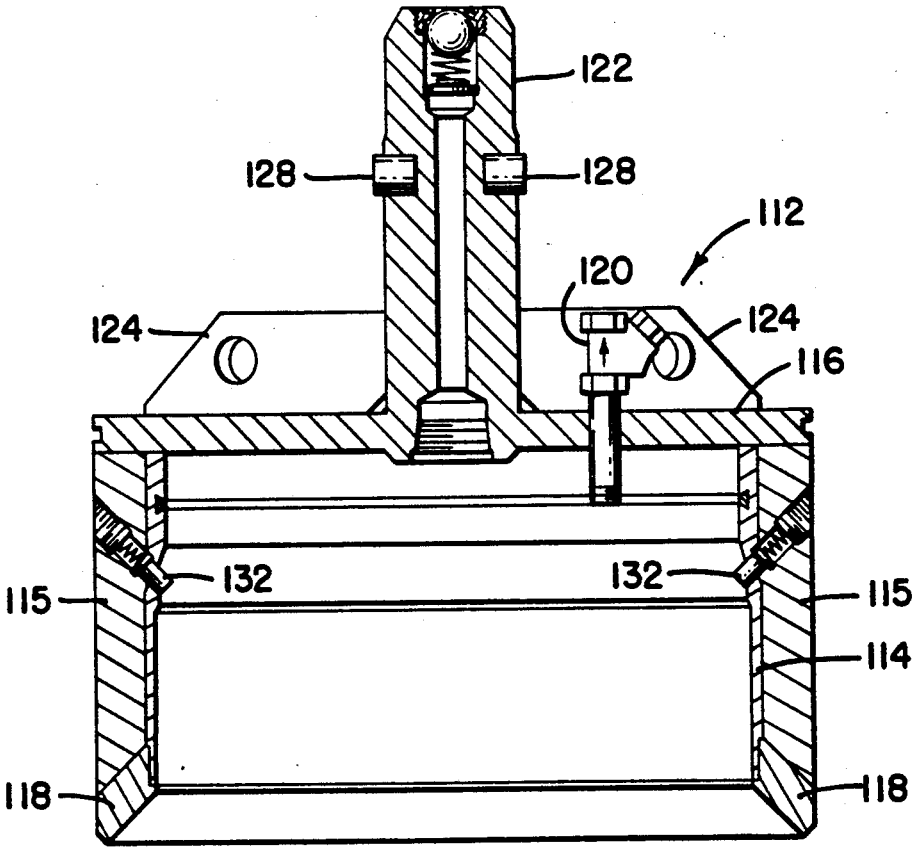
FIG. 7 is an elevation in section of a third embodiment of a protective cap according to the present invention.
Figure 8:
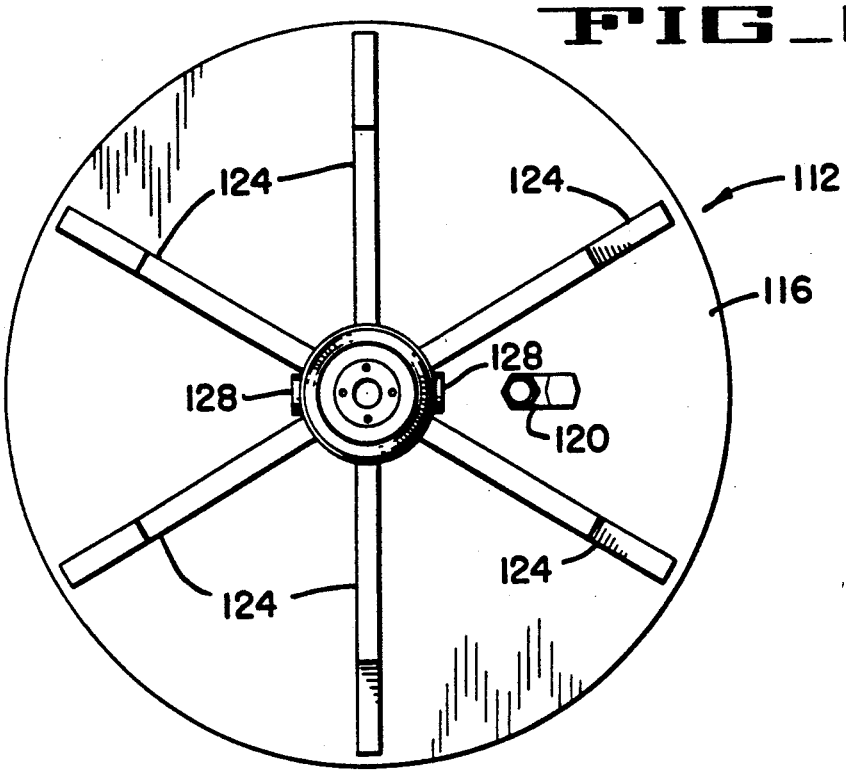
FIG. 8 is a plan view of the protective cap of FIG. 7.

A third embodiment of the protective cap according to the present invention is illustrated in FIGS. 7 and 8. This cap 112 has a cylindrical wall 114 with a conical-shaped lower end 118, and a flat upper end wall 116. Spaced around the outside of cylindrical wall 114 are gussets 115 that extend between the upper surface of the lower end 118 and the lower surface of the upper end wall 116. Slant-oriented holes through the gussets 115 and cylindrical wall 114 support spring-biased retractable pins 132, and one-way fluid flow valve 120 is mounted on the end wall 116.

The cap 112 also includes a stem 122 that may be formed integrally with the end wall 116 and reinforced by ribs 124 which are similar to ribs 24 in the embodiment of FIG. 1. Mounted in and protruding radially outward from the stem 122 are a plurality of lugs 128, two of which are illustrated although three may be preferred. The lugs 128 do not shear, but instead engage and cooperate with inverted J-shaped openings in a lower sleeve-like portion of a tool 137 (FIG. 9) to releasably connect the cap 112 to that tool.

Figure 9:
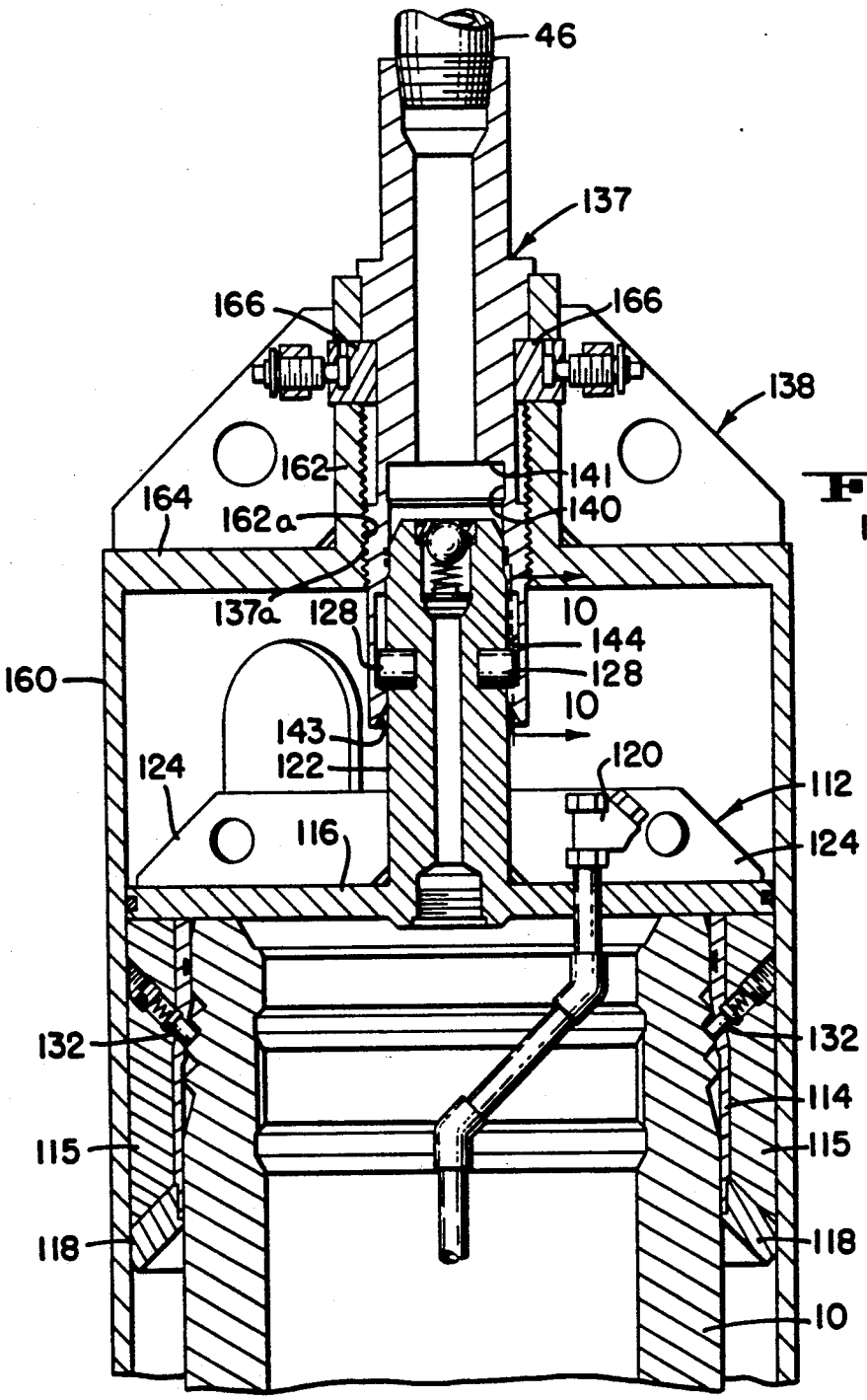
FIG. 9 is an elevation in central section showing the protective cap of FIGS. 7 and 8 in position on a wellhead, and a modified form of running tool attached to this cap.
Figure 10:
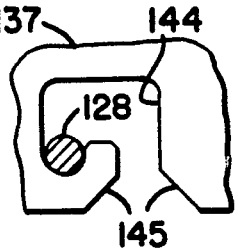
FIG. 10 is a fragmentary view taken along line 10—10 of FIG. 9 illustrating the attachment mechanism between the tool and the protective cap.

In FIG. 9 the tool 137 is shown threaded into the top portion of a tool 138 similar to that described in connection with FIGS. 5 and 6. The upper portion of the cap stem 122 extends into a counterbore 140, with an end wall 141 in the lower portion of tool 137 which has internal threads at its upper end for connection to a drill string 46 such as illustrated in FIG. 4. The lower end portion of tool 137 has a conical surface 143 that assists in alignment of the tool and the cap stem 122 during their connection operation. Above the surface 143, and in the counterbore 140, are a plurality of lug receiving slots 144, one for each lug 128. Each slot 144 may have the shape of an inverted "J" as illustrated in FIG. 10, which shows the outline of the slots as a developed view. The J-shaped slot 144 has a tapered entry 145 so that when the tool 137 is rotated relative to stem cap 122 the tool 137 will descend when the entry 145 and a lug 128 are aligned. After lugs 128 have fully entered the J-shaped slots 144, further rotation of tool 137 will seat lug 128 in a recess as illustrated in FIG. 10. The protective cap 112 then can be lifted and transported to the subsea wellhead 10. Following installation of the protective cap 112 on the wellhead 10, rotation of tool 137 in the opposite direction to align lugs 128 with the openings in the J-shaped slots 144 allows removal of the tool for retrieval aboard the surface vessel.

To retrieve the protective cap 112, the tool 137 without change is lowered onto stem 122, rotated to lock lugs 128 into the J-shaped slots 144, and lifted with a force sufficient to shear or otherwise render ineffective the slidably mounted pins 132 in the cylindrical wall 114 of the cap 112. The cap is thus captured and can be raised to the surface vessel for reuse.

FIG. 9 also illustrates an upper structure for attaching the tool 137 to a guide base tool 138 for retrieving or running a subsea well guide base as discussed in connection with FIGS. 5 and 6 respectively. The tool 137 has external threads 137*a* to cooperate with internal threads 162*a* in a central hub 162 that is attached to the upper end wall 164 of the tool 138. The hub 162 is provided with anti-rotation lugs 166 that can be moved radially outwardly from their illustrated functional engagement with the tool 137 to facilitate rotating the tool to adjust its longitudinal spacing with respect to the tool 138. FIG. 11 illustrates a combination of the protective cap 12*a* of FIG. 6 with the guide base retrieval tool 60 of FIG. 5, showing how hydraulic release of the tool 60 from the cap 12*a* can be accomplished. To effect such release, a ball 200 is dropped down the running string 88 onto an upwardly-facing seat 202 in the upper end of the cap stem 22. Hydraulic pressure is then exerted through the running string 88 and between the cap stem 22 and surrounding neck of the tool 60 into the annular chamber C between the upper end walls of the cap and the tool. When this pressure exceeds the strength of the pins 48 they shear, disconnecting the tool 60 from the cap and facilitating retrieval of the tool and attached guide base 62 by lifting on the running string 88 (right half of FIG. 11).

FIG. 12 illustrates an alternate location of the shear pins 48 and retrieval pins 50, herein between the cylindrical wall of the tool 60 and the adjacent cylindrical wall 14*a* of the protective cap 12*a*. It should be understood that this alternate pin location also can be employed with the other embodiments of the invention.

An advantage of having a protective cap and tool with the size and shape as illustrated is that with one trip to the undersea wellhead two functions can be performed, thereby saving time and expense.

With both illustrated forms of the protective cap and tool, the parts are reusable with any wellhead having the same diameter. The fractured pins in the cylindrical wall section of the protective cap and the sheared pins 148 of the tool in FIGS. 2 and 3 are easily replaced.

While several embodiments of the invention have been described, other changes and modifications will become apparent to those working in this art. All changes and modifications which fall within the scope of the claims and equivalents thereof are intended to be covered thereby.

We claim:

1. A removable protective cap adapted for use on a subsea wellhead during a period when work on a well through said wellhead is temporarily suspended or abandoned, said cap being installable on and removable from said wellhead without the use of hydraulic pressure and/or apparatus, said cap comprising:

an inverted cup-shaped member having a generally cylindrical wall, an open bottom area and a top portion on an upper end of said cylindrical wall;

a plurality of spring loaded shear pins circumferentially spaced about a central portion of said cylindrical wall, said pins being spring-biased toward a position protruding through said wall portion for cooperative engagement with an annular groove on said wellhead to shearably secure said cap to said wellhead, said pins being mounted for retractable sliding movement against said spring bias as said cap is installed on said wellhead, said movement occurring along an axis that is tilted at an angle relative to a central axis for said cylindrical wall portion; and means for connecting the cap to a running and retrieving tool, said means comprising a central stem extending upwardly from the top portion of the cup-shaped member and having a profile adapted for attachment to a running and retrieval tool operated from a remote location, said profile including an annular downwardly-facing shoulder for cooperation with radially-oriented pins in said running and retrieval tool.

2. The protective cap of claim 1 further having a fluid channel passing through said top portion including a one-way flow valve means which allows fluid flow outwardly from the inside of said inverted cup-shaped member to relieve pressure build-up below the cap.

3. The protective cap of claim 2 wherein the cylindrical wall contains a circumferential groove on an inner surface for receiving an O-ring, said groove being positioned between said pins and said top portion, and there being a hollow pipe extending along the direction of the cylindrical wall portion axis that is effective to provide a fluid flow path between a position below said circumferential groove and said one-way valve means.

4. The protective cap of claim 1 wherein the tilt angle axis is about 45° with respect to said central axis.

5. The protective cap of claim 1 further having a fluid channel passing through said stem, and a second one-way flow valve means located in said channel to control fluid injection into said inverted cup-shaped member.

6. The protective cap of claim 1 together with a running and retrieval tool capable of selective detachment when the protective cap is placed on a wellhead and capable of attachment when the protective cap is to be retrieved from said wellhead, said tool being controlled at a remote location through a drill string for raising and lowering said protective cap.

7. The protective cap of claim 6 wherein the spring loaded shear pins in the cylindrical wall portion of said protective cap retract against their spring bias when the protective cap is forced downwardly over an outer surface of the wellhead and then protrude through said cap wall portion into coöperative engagement with said annular groove on said wellhead.

8. The protective cap of claim 7 wherein said cap is removed from the wellhead by a non-hydraulic lifting force applied to said central stem, said lifting force being sufficient to cause shearing of said retractable shear pins in said cylindrical wall portion.

9. The protective cap of claim 8 wherein said stem includes a circumferential groove, wherein the tool includes a first set of radially inwardly extending pins which fit into said circumferential groove during a running of the tool for installation of said protective cap on said wellhead, said first set of pins shearing at a lifting force on the tool that is less than the lifting force required for shearing the retractable shear pins in said cylindrical wall portion.

10. The protective cap of claim 9 wherein the tool when used for retrieval of the protective cap contains a plurality of radially disposed pins that are spring biased to fit into the circumferential groove on said stem said spring biased pins on said tool resisting shearing under a lifting force that is sufficient to shear the retractable pins in said cylindrical wall portion.

11. The protective cap of claim 10 wherein the first set of radially inwardly extending pins do not shear when subjected to a pulling force of 10,000 pounds but do shear with an overpull of about 30,000 pounds and the retractable pins in said cylindrical wall portion shear to allow retrieval with an overpull of about 80,000 pounds.

12. The protective cap of claim 8 wherein said stem includes radially outwardly extending lugs and the tool has a lower end portion containing a central longitudinal bore sized to fit over said stem and including slots each having an inverted J-shaped opening that allows removal of the tool when the protective cap is installed on said wellhead by rotation of the tool to rotate said J-shaped slots by an amount sufficient to locate said lugs in open channels of said slots followed by lifting of the tool.

13. The protective cap of claim 12 wherein the protective cap is removed after the tool is lowered to place the J-shaped openings on said hubs and the tool is rotated to lock the hubs in their respective J-shaped openings followed by lifting with a force sufficient to shear retractable pins in said cylindrical wall portions.

14. Apparatus including a running tool and protective cap coupled together for installing the cap on a subsea wellhead without the use of hydraulic pressure, said protective cap comprising:

a generally cylindrical body having an open bottom portion adapted to fit over an upwardly extending undersea well pipe which has a undulating outer cylindrical surface around which said cylindrical body is mounted;

a plurality of shear pins that are mounted on said cylindrical body for siding movement against a bias force along an axis that is tilted relative to a central axis of said cylindrical body, whereby the cap is installable over said well pipe undulating surface merely by a downward mechanical stabbing action and separable from said well pipe merely by a mechanical lifting action that shears said shear pins;

a top wall covering said cylindrical body to prevent entry of foreign objects into said wellhead; and one-way check valve means in said top wall to relieve pressure buildup below said cap.

15. Apparatus as defined in claim 14 wherein the tool is connected to a drill string and selectively disconnectable from the protective cap after installation of the cap on the wellhead and capable of being reconnected to the cap for cap retrieval.

16. Apparatus as defined in claim 15 wherein the same tool is used for cap installation and cap retrieval and the tool is selectively attached to or disconnected from a profiled stem extending upwardly from the top wall of said cap.

17. Apparatus as defined in claim 14 wherein the cap has a stem extending upwardly from said top wall, said stem including an annular groove, and wherein the tool has a lower end portion that fits over said stem and contains a plurality of fixed pins and a plurality of retractable pins, said pins being adapted to fit into said groove, and means on said tool for locking the retractable pins in a non-operable condition during installation of the protective cap on said wellhead and separation of said tool from said cap by shearing said fixed pins.

18. Apparatus as defined in claim 17 wherein the tool is reinstalled on said stem for retrieval of said protective cap while the retractable pins are released by said locking means.

19. Apparatus as defined in claim 14 wherein the cap includes a stem having a plurality of radially extending lugs and the tool includes a lower end that fits over said stem and lugs, said tool having an inverted J portion adapted to be installed over or removed from said lugs by a combination of axial and rotary movements through operation of said drill string.

20. A non-hydraulic well tool for removing a well guide base from a position on the seafloor where the guide base is secured by a locking ring to a well pipe housing that surrounds a well pipe and for concomitantly installing a protective cap on said well pipe, said tool comprising:

a hollow housing with means for attachment to a running string;

at lease one retrieval pin assembly secured to the housing and operable to engage a release element on a subsea well component and cause said release element to effect disengagement of the subsea well component from another subsea well structure;

non-hydraulic means including said running string to lift the housing with respect to the subsea well structure to disengage the subsea well component therefrom;

said protective cap being carried downwardly and attached to an upper end of said well pipe to cover said well pipe when said hollow housing is lowered to engage said subsea well component, said protective cap having a profiled stem extending upwardly along an axis of said hollow housing; and non-hydraulic means for releasably coupling the hollow housing to the profiled stem to allow the protective cap to remain attached to the subsea well structure as the subsea well component is raised to a servicing vessel.

21. A well tool as defined in claim 20 further having means in an upper portion of said hollow housing for holding said protective cap while the hollow housing is positioned over said well guide base, said holding means including fixed shear pins which engage said profiled stem, said shear pins being sheared as said housing and well guide base are lifted while leaving said protective cap on said well pipe.

22. A well tool as defined in claim 20, wherein the coupling means comprises lugs on said stem and inverted J-shaped slots in the upper portion of said housing, said J-shaped slots being slidable over said lugs and rotatable to unlock the lugs from the slots whereby the protective cap remains in position while the subsea component and housing are raised to the service vessel.

23. A running and retrieving tool, operable without the use of hydraulic pressure and/or apparatus, for installing a well guide base and for removing a temporary protective cap that has been removably installed on a subsea wellhead, said tool comprising:

a housing with means for attachment to a pipe string, said housing including a circumferential flange with a plurality of axial bores;

means for non-hydraulically and releasably attaching said housing to a subsea well guide base, said means including corresponding bores in said guide base, (i) rod-like elements extending through said housing bores and into said corresponding bores in said guide base, and (ii) means to secure said rod-like elements to said guide base and to release said elements from said base upon exertion of a predetermined axial force on said elements;

means to non-hydraulically lift the housing with respect to the guide base to disengage said housing from said guide base;

said protective cap being attached to an upper portion of said wellhead by non-hydraulic means including shear pins, said cap having a profiled stem extending upwardly along an axis of said well guide base and into engagement with an upper portion of said housing; and means for non-hydraulically coupling the housing to the profiled stem of the protective cap so that said shear pins fail in response to an over-pull force on said pipe string to thereby allow retrieval of said protective cap.

24. A running and retrieving tool as defined in claim 23 where the coupling means comprises a plurality of radially disposed spring biased pins in the housing upper portion for engagement with the profiled portion of said stem for engaging the stem as the guide base is placed in position and for removing said cap concomitantly with removal of said housing while said well guide base remains on the seafloor.

25. A running and retrieving tool as defined in claim 23 wherein the coupling means comprises lugs on said stem and inverted J-shaped slots that are part of the upper portion of said housing, said J-shaped slots being slidable over said lugs and rotatable to lock the lugs in the slots whereby the protective cap is removed concomitantly with removal of said housing while said guide base remains at the seafloor.

* * * * *